US008698673B2

(12) United States Patent
Wong et al.

(10) Patent No.: US 8,698,673 B2
(45) Date of Patent: Apr. 15, 2014

(54) MULTIBAND ANTENNA

(75) Inventors: Kin-Lu Wong, Tapei Hsien (TW); Li-Chun Lee, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 787 days.

(21) Appl. No.: 12/559,569

(22) Filed: Sep. 15, 2009

(65) Prior Publication Data

US 2010/0328182 A1 Dec. 30, 2010

(30) Foreign Application Priority Data

Jun. 29, 2009 (TW) ..... 98121911 A

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702, 833
See application file for complete search history.

(56) References Cited

U.S. PATENT DOCUMENTS

2007/0120745 A1* 5/2007 Qi et al. ..... 343/702
2008/0180333 A1* 7/2008 Martiskainen et al. ..... 343/722
2008/0246665 A1* 10/2008 Kurashima et al. .... 343/700 MS
2009/0073059 A1* 3/2009 Ikegaya ..... 343/702

FOREIGN PATENT DOCUMENTS

TW I293215 B 2/2008

* cited by examiner

*Primary Examiner* — Robert Karacsony
(74) *Attorney, Agent, or Firm* — Alan Kamrath; Kamrath IP Lawfirm, P.A.

(57) ABSTRACT

A multiband antenna includes a ground plane, a dielectric substrate and a radiating metal portion. The dielectric substrate is located at one side edge of the ground plane. The radiating metal portion is disposed on one surface of the dielectric substrate and includes a first metal portion and a second metal portion. The first metal portion is substantially of an L-shape. One end of the first metal portion is adjacent to the side edge of the ground plane and is the antenna's feeding point connected to a signal source, and the other end of the first metal portion is an open end. The second metal portion comprises a U-shape portion. The second metal portion includes a first open end and a second open end, which are respectively located on two opposite sides of the open end of the first metal portion. The first open end has a first coupling gap between the first open end and the open end of the first metal portion, and the second open end has a second coupling gap between the second open end and the open end of the first metal portion. The second metal portion is further short-circuited to the ground plane by a shorting metal line.

12 Claims, 2 Drawing Sheets

MULTIBAND ANTENNA

BACKGROUND OF THE INVENTION

1. Field of the Invention

The present invention relates to an antenna and, more particularly, to a multiband antenna which is able to cover multiband operation in mobile communication devices.

2. Description of the Related Art

Recently, various kinds of wireless communication applications emerge with the development and improvement of wireless communication technologies, such as laptop computers combined with wireless communication capabilities. For the present, most laptop computers are capable of wireless local area network (WLAN) operation. However, in order to provide more functionalities, laptop computers should be equipped with antennas capable of multiband operation to cover the wireless wide area network (WWAN) operation as well.

The WLAN antennas used in prior-art laptop computers are mostly inverted-F antennas, which bring challenges to engineers because of their sizes when they are applied for WWAN operation. In the prior art technique such as that disclosed in the Taiwan Patent No. I293215 entitled "Dual-Band Inverted-F Antenna", a dual-band antenna uses a ground plane formed by a supporting metal frame of a LCD panel to achieve dual-band operation. However, the antenna is only suitable for WLAN operation. When the antenna is applied for multiband WWAN operation, it is difficult to be embedded inside a mobile communication device because the antenna will have a large size.

Therefore, in view of the deficiencies of prior-art techniques, it is necessary to provide a multiband antenna suitable to solve the problem presented in the prior art techniques.

SUMMARY OF THE INVENTION

It is an object of the present invention to provide a multiband antenna which can generate two wide operating bands in covering multiband WWAN operation and occupy a reduced antenna size.

The multiband antenna comprises a ground plane, a dielectric substrate and a radiating metal portion. The dielectric substrate is located at a side edge of the ground plane. The dielectric substrate is substantially parallel to the ground plane and extends outwardly. The radiating metal portion comprises a first metal portion and a second metal portion. The first metal portion is substantially of an L shape. One end of the first metal portion is adjacent to the side edge of the ground plane and is a feeding point connected to a signal source. The other end of the first metal portion is an open end. The second metal portion includes a U-shaped portion and comprises a first open end and a second open end respectively located on two opposite sides of the open end of the first metal portion. The first open end has a first coupling gap between the first open end and the open end of the first metal portion. The second open end has a second coupling gap between the second open end and the open end of the first metal portion. The second metal portion is further short-circuited to the ground plane by a shorting metal line.

Hence, the present invention provides a multiband antenna with an innovative structure for various wireless communication applications.

DETAILED DESCRIPTION OF THE PREFERRED EMBODIMENTS

The advantages and innovative features of the invention will become more apparent from the following detailed description when taken in conjunction with the accompanying drawings.

Figure 1:
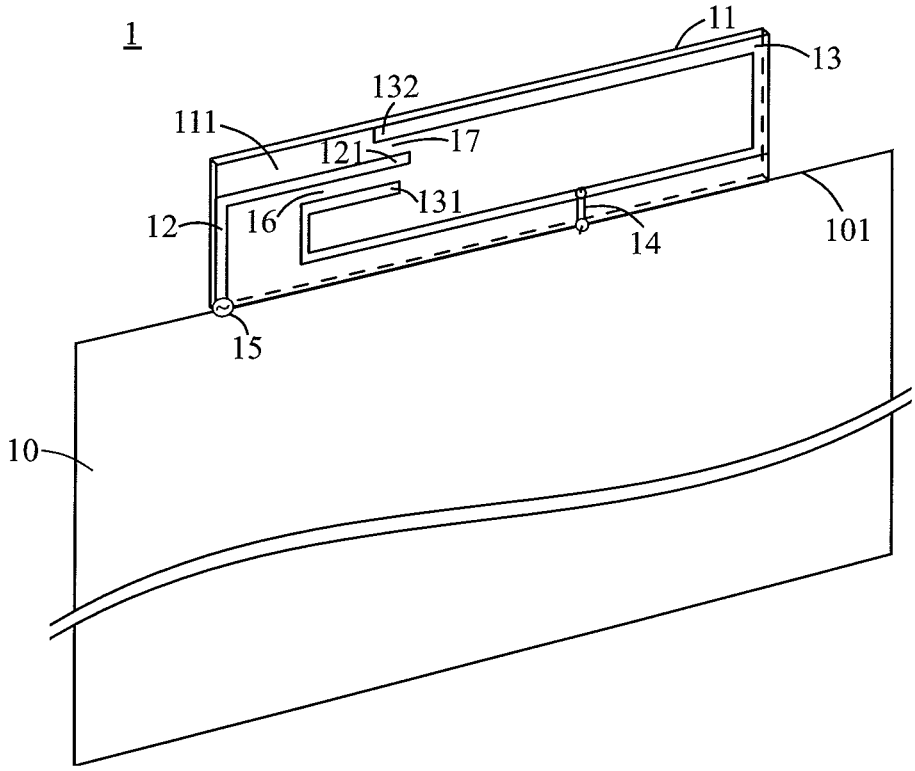
FIG. 1 illustrates a structural view of a first embodiment of a multiband antenna in the present invention.
Figure 2:
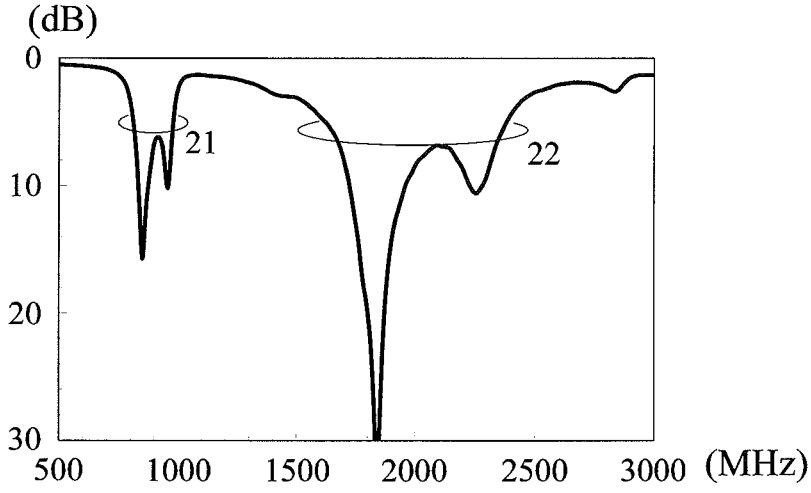
FIG. 2 illustrates a diagram of a measured return loss of the first embodiment of the multiband antenna in the present invention.

Please refer to FIG. 1 and FIG. 2 for the first embodiment of the multiband antenna in the present invention. FIG. 1 illustrates a structural view of the first embodiment of the multiband antenna. FIG. 2 illustrates a diagram of a measured return loss of the first embodiment of the multiband antenna.

In FIG. 1, a multiband antenna 1 comprises a ground plane 10, a dielectric substrate 11 and a radiating metal portion. The ground plane 10 can be applied as a supporting metal frame of a LCD panel of a laptop computer. However, there can be different applications for the ground plane 10.

The dielectric substrate 11 is disposed on a side edge 101 of the ground plane 10. The dielectric substrate 11 is substantially parallel to the ground plane 10 and extends outwardly. The ground plane 10 does not overlap with the dielectric substrate 11 at any portion, and in this embodiment, the ground plane 10 and the dielectric substrate 11 are substantially coplanar. The ground plane 10 is parallel to the dielectric substrate 11 to meet the practical application. However, there can be other angles between the ground plane 10 and the dielectric substrate 11.

The radiating metal portion comprises a first metal portion 12 and a second metal portion 13. For example, the radiating metal portion can be formed on a surface 111 of the dielectric substrate 11 by printing or etching.

In this embodiment, the first metal portion 12 is substantially of an L shape. One end of the first metal portion 12 is adjacent to the side edge 101 of the ground plane 10 and is an antenna's feeding point connected to a signal source 15. The other end of the first metal portion 12 is an open end 121.

Also in FIG. 1, the second metal portion 13 includes a U-shaped portion. In this embodiment, the second metal portion 13 consists of two U-shaped portions and comprises four bendings. The smaller U-shaped portion is for obtaining an increased length of the metal portion. It is noted that the second metal portion 13 can be formed with other shapes.

The second metal portion 13 comprises a first open end 131 and a second open end 132. The first open end 131 and the second open end 132 are located respectively on two sides of the open end 121 of the first metal portion 12, so the open end 121 of the first metal portion 12 is disposed between the first open end 131 and the second open end 132.

The present invention is characterized in the coupling gap and the coupling lengths between the open end 121 of the first metal portion 12 and the first open end 131/the second open end 132 of the second metal portion 13. In this embodiment, the first open end 131, the second open end 132 of the second metal portion 13 and the open end 121 of the first metal portion 12 are slightly parallel to each other to help minimize the size of the multiband antenna. However, the first open end 131, the second open end 132 of the second metal portion 13 and the open end 121 of the first metal portion 12 are not necessarily parallel to each other.

A first coupling gap 16 is formed between the first open end 131 and the open end 121 of the first metal portion 12, and a second coupling gap 17 is formed between the second open end 132 and the open end 121 of the first metal portion 12. The second metal portion 13 is further short-circuited to the ground plane 10 by a shorting metal line 14. The first coupling gap 16 and/or the second coupling gap 17 are less than 2 mm. Furthermore, at least one of the coupling gap should be less than 2 mm whether the first open end 131, the second open end 132 of the second metal portion 13 and the open end 121 of the first metal portion 12 are parallel to each other or not.

It is noted that the first metal portion 12 and/or the second metal portion 13 can have bending angles other than 90 degrees to form a V shape or an arc. However, the first coupling gap 16 and/or the second coupling gap 17 should be less than 2 mm.

Furthermore, in the present invention, the first metal portion 12 and the second metal portion 13 are on the same surface of the dielectric substrate 11. It is noted that the first metal portion 12 and the second metal portion 13 could be on different surfaces of the dielectric substrate 11 respectively.

FIG. 2 illustrates a diagram of a measured return loss of the first embodiment of the multiband antenna 1 in the present invention. In this embodiment, in order to simulate the supporting metal frame of the LCD panel of laptop computer, the ground plane 10 is chosen to be 260 mm long and 200 mm wide. The radiating metal portion is formed by printing or etching on the dielectric substrate 11 which is 65 mm long, 10 mm wide and 0.8 mm thick.

The signal source 15 feeds the energy to the first metal portion 12, which is then coupled from the first metal portion 12 to the second metal portion 13 via the first coupling gap 16 (which has a width of less than 2 mm). The first metal portion 12, the second metal portion 13 and the first coupling gap 16 form a loop-like path to the shorting metal line 14. Similarly, the energy can be coupled to the second metal portion 13 via the second coupling gap 17 (which has a width of less than 2 mm). The first metal portion 12, the second metal portion 13 and the second coupling gap 17 form another loop-like path to the shorting metal line 14. Each one of the two loop-like paths can excite a half-wavelength resonant mode to be combined into a wide lower band 21 for the multiband antenna 1, and each one of the two loop-like paths can excite a full-wavelength resonant mode to be combined into a wide higher band 22. From the experimental result, with the definition of 6 dB return loss, the bandwidth of the lower band 21 is about 155 MHz (815~970 MHz), which can cover the GSM850/900 operation, and the bandwidth of the higher band 22 is about 695 MHz (1655~2350 MHz), which can cover the GSM1800/1900 and UMTS operation.

Figure 3:
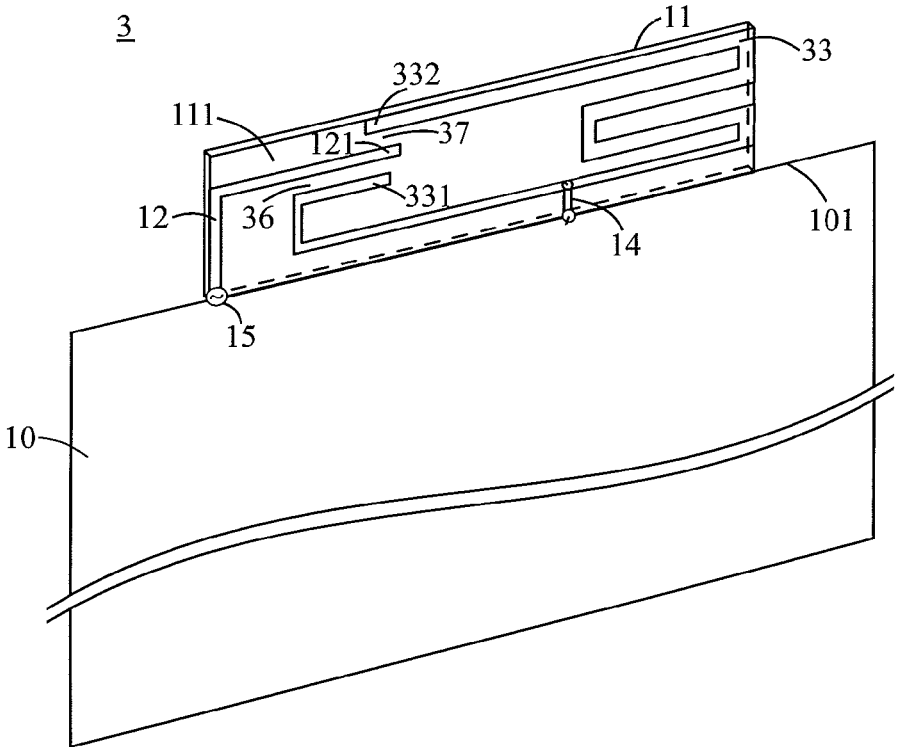
FIG. 3 illustrates a structural view of a second embodiment of the multiband antenna in the present invention.

FIG. 3 illustrates a structural view of a second embodiment of a multiband antenna 3 in the present invention. The multiband antenna 3 comprises the ground plane 10, the dielectric substrate 11 and the radiating metal portion. The radiating metal portion comprises the first metal portion 12 and the second metal portion 33. What is different from the first embodiment is that, in the second embodiment, the second metal portion 33 has a plurality of bendings to form a meandered structure to reduce the occupied space. However, there can be various numbers of bendings and the bending method in the present invention. No matter how the second metal portion 33 is bent, both the first coupling gap 36 between the open end 121 of the first metal portion 12 and the first open end 331, and the second coupling gap 37 between the second open end 332 and the open end 121 of the first metal portion 12 should be less than 2 mm. The overall structure of the multiband antenna 3 of the second embodiment is similar to that of the first embodiment. Therefore, the second embodiment can achieve the similar result as that of the first embodiment.

Figure 4:
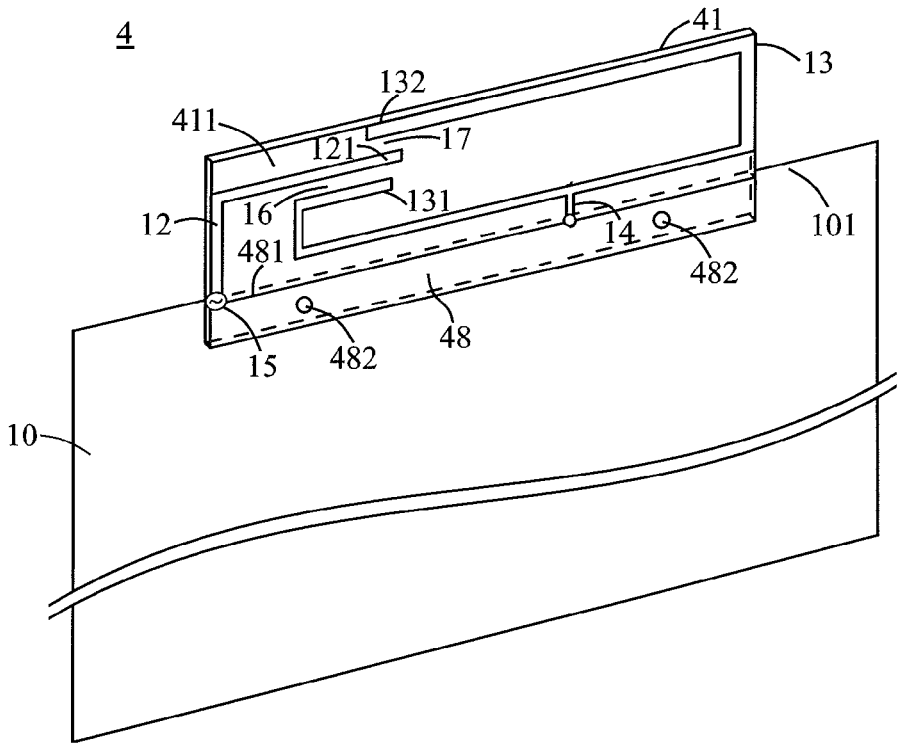
FIG. 4 illustrates a structural view of a third embodiment of the multiband antenna in the present invention.

Please refer to FIG. 4 for a structural view of a third embodiment of a multiband antenna 4 in the present invention. The multiband antenna 4 comprises the ground plane 10, the dielectric substrate 41 and the radiating metal portion. For example, the ground plane 10 can be a supporting metal frame of a LCD panel of a laptop computer. The dielectric substrate 41 is located at the side edge 101 of the ground plane 10 (with a portion of the dielectric substrate 41 overlapping the side edge 101), and the dielectric substrate 41 is approximately parallel to the ground plane 10 and extends outwardly.

In this embodiment, the radiating metal portion is formed on a surface 411 of the dielectric substrate 41 by printing or etching. The radiating metal portion comprises an antenna ground plane 48, the first metal portion 12 and the second metal portion 13. This embodiment is designed to meet different antenna implementations. The radiating metal portion is first electrically connected to the antenna ground plane 48, and, then, the antenna ground plane 48 is electrically connected to the ground plane 10.

The antenna ground plane 48 is electrically connected to the ground plane 10 via at least one connecting point 482. The first metal portion 12 is substantially of an L shape. One end of the first metal portion 12 is adjacent to the side edge 101 of the antenna ground plane 48 and is the antenna's feeding point which is further connected to the signal source 15. The other end of the first metal portion 12 is the open end 121. The second metal portion 13 comprises a U-shaped portion and has the first open end 131 and the second open end 132. The the first open end 131 and the second open end 132 are respectively located on two sides of the open end 121 of the first metal portion 12. The first open end 131 has a first coupling gap 16 between the first open end 131 and the open end 121 of the first metal portion 12, and the second open end 132 has a second coupling gap 17 between the second open end 132 and the open end 121 of the first metal portion 12. The second metal portion 13 is further short-circuited to the antenna ground plane 48 by the shorting metal line 14. The antenna structure of the multiband antenna 4 is similar to that of the multiband antenna 1. Therefore, the third embodiment can provide similar result as that of the first embodiment.

It is noted that the multiband antenna in the present invention is illustrated by using a laptop computer as an application. However, the multiband antenna can be applied in other mobile communication devices.

As described above, in the present invention, the radiating metal portion comprises the first metal portion and the second metal portion. In the radiating metal portion, the electromagnetic energy is coupled from the first metal portion to the second metal portion via the first coupling gap and the second coupling gap respectively to excite the second metal portion. A loop-like path along the first metal portion, the first coupling gap, and the shorting point of the second metal portion until the edge of the ground plane can excite a half-wavelength resonant mode in the lower band (around 850 MHz), and another loop-like path along the first metal portion, the second coupling gap, and the shorting point of the second metal portion until the edge of the ground plane can also excite a half-wavelength resonant mode in the lower band (around 900 MHz). The two resonant modes in the lower band are formed into a wide lower band for the multiband antenna. Furthermore, the two loop-like paths can also generate full-wavelength resonant modes in the higher band (around 2,000 MHz) respectively to be incorporated into a wide higher band for the multiband antenna. By adjusting the widths of the first coupling gap and the second coupling gap (both less than 2 mm), the multiband antenna can achieve good impedance matching in both lower and higher bands to meet the multiband operation covering the GSM850/900/1800/1900/UMTS bands. Also, the multiband antenna has a thickness of less than 1 mm and has a size of less than 65×10 $mm^2$ to help reduce the occupied space. Furthermore, the multiband antenna has a simple structure and can be formed on the dielectric substrate by printing or etching on one surface, making it possible to be embedded inside a thin-profile laptop computer. Therefore, the multiband antenna can be applied as an internal antenna.

It is noted that the above-mentioned embodiments are only for illustration, and it is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A multiband antenna comprising:

a ground plane including a side edge;

a dielectric substrate including a surface, wherein the dielectric substrate is located at the side edge of the ground plane, and wherein the dielectric substrate is substantially parallel to the ground plane and extends outwardly; and a radiating metal portion disposed on the surface of the dielectric substrate, with the radiating metal portion comprising:

a first metal portion substantially of an L shape, with the first metal portion having one end adjacent to the side edge of the ground plane and extending in a direction, wherein the one end of the first metal portion is a feeding point connected to a signal source, with the first metal portion having another end as an open end; and a second metal portion including a U-shaped portion, with the second metal portion comprising a first open end and a second open end respectively located on two opposite sides of the open end of the first metal portion and respectively extending in opposite directions, wherein a first coupling gap is formed between the first open end and the open end of the first metal portion; wherein a second coupling gap is formed between the second open end and the open end of the first metal portion; wherein the second metal portion is short-circuited to the ground plane by a shorting metal line, wherein the shorting metal line is disposed between the first open end and the second open end.

2. The multiband antenna as claimed in claim 1, wherein the ground plane is a supporting metal frame of a LCD panel of a laptop computer.

3. The multiband antenna as claimed in claim 1, wherein the radiating metal portion is formed on the dielectric substrate by etching or printing.

4. The multiband antenna as claimed in claim 1, wherein the first coupling gap or the second coupling gap is less than 2 mm.

5. The multiband antenna as claimed in claim 1, wherein the shorting metal line is distant from the open end of the first metal portion.

6. The multiband antenna as claimed in claim 1, wherein the first open end of the second metal portion is located intermediate the open end of the first metal portion and the radiating metal portion, and wherein the first open end of the second metal portion extends in a same direction as the open end of the first metal portion.

7. A multiband antenna comprising:

a ground plane including a side edge;

a dielectric substrate including a surface, wherein the dielectric substrate is located at the side edge of the ground plane, and wherein the dielectric substrate is substantially parallel to the ground plane and extends outwardly; and a radiating metal portion disposed on the surface of the dielectric substrate, with the radiating metal portion comprising:

an antenna ground plane electrically connected to the ground plane via at least one connecting point;

a first metal portion substantially of an L shape, with the first metal portion having one end adjacent to a side edge of the antenna ground plane, wherein the one end of the first metal portion is a feeding point connected to a signal source, with the first metal portion having another end extending in a direction as an open end; and a second metal portion including a U-shaped portion, with the second metal portion comprising a first open end and a second open end respectively located on two opposite sides of the open end of the first metal portion and respectively extending in opposite directions, wherein a first coupling gap is formed between the first open end and the open end of the first metal portion; wherein a second coupling gap is formed between the second open end and the open end of the first metal portion; wherein the second metal portion is short-circuited to the antenna ground plane by a shorting metal line, wherein the shorting metal line is disposed between the first open end and the second open end.

8. The multiband antenna as claimed in claim 7, wherein the ground plane is a supporting metal frame of a LCD panel of a laptop computer.

9. The multiband antenna as claimed in claim 7, wherein the radiating metal portion is formed on the dielectric substrate by etching or printing.

10. The multiband antenna as claimed in claim 7, wherein the first coupling gap or the second coupling gap is less than 2 mm.

11. The multiband antenna as claimed in claim 7, wherein the shorting metal line is distant from the open end of the first metal portion.

12. The multiband antenna as claimed in claim 7, wherein the first open end of the second metal portion is located intermediate the open end of the first metal portion and the radiating metal portion, and wherein the first open end of the second metal portion extends in a same direction as the open end of the first metal portion.

* * * * *